US010485271B2

(12) United States Patent
Cheung

(10) Patent No.: US 10,485,271 B2
(45) Date of Patent: Nov. 26, 2019

(54) BRA CUP AND MANUFACTURING METHOD THEREOF

(71) Applicant: Kaiping U-like Undergarment Accessories Co., Ltd., Kai Ping, Guangdong (CN)

(72) Inventor: Suilung Cheung, Kai Ping (CN)

(73) Assignee: Kaiping U-Like Undergarment Accessories Co., Ltd., Kai Ping, Guangdong (CN)

( * ) Notice: Subject to any disclaimer, the term of this patent is extended or adjusted under 35 U.S.C. 154(b) by 160 days.

(21) Appl. No.: 15/699,428

(22) Filed: Sep. 8, 2017

(65) Prior Publication Data

US 2019/0075855 A1 Mar. 14, 2019

(51) Int. Cl.

| | |
|---|---|
| ***A41C 5/00*** | (2006.01) |
| ***A41C 3/12*** | (2006.01) |
| ***A41C 3/00*** | (2006.01) |
| ***A41C 3/14*** | (2006.01) |

(52) U.S. Cl.

CPC ..... *A41C 5/005* (2013.01); *A41C 3/0014* (2013.01); *A41C 3/12* (2013.01); *A41C 3/144* (2013.01)

(58) Field of Classification Search

CPC ..... A41C 5/005; A41C 5/0014; A41C 3/12; A41C 3/144

USPC ..... 450/39

See application file for complete search history.

(56) References Cited

U.S. PATENT DOCUMENTS

| | | | | | |
|---|---|---|---|---|---|
| 4,398,981 | A * | 8/1983 | Ellis | A41C 3/144 | 156/217 |
| 5,522,892 | A * | 6/1996 | Lin | A41C 3/144 | 450/39 |
| 5,683,286 | A * | 11/1997 | Kielland | A61F 13/141 | 2/267 |
| 5,951,367 | A * | 9/1999 | Hsu | A41C 3/144 | 2/267 |
| 6,921,316 | B1 * | 7/2005 | Jian | A41C 3/105 | 450/38 |
| 7,214,121 | B1 * | 5/2007 | Huang | A41C 3/10 | 450/38 |
| 2004/0142634 | A1 * | 7/2004 | Luk | A41C 3/0085 | 450/57 |
| 2004/0147203 | A1 * | 7/2004 | Luk | A41C 3/12 | 450/39 |

(Continued)

*Primary Examiner* — Gloria M Hale

(74) *Attorney, Agent, or Firm* — Muncy, Geissler, Olds & Lowe, P.C.

(57) ABSTRACT

The present invention relates to the field of undergarments, bras, or swimsuit accessories, and is directed to providing a bra cup having sustainable three-dimensional corrugations and a manufacturing method thereof with simple processes. The bra cup is formed by compression molding with a composite layer material and has a protruding outer side face and a concave inner side face. The outer side face has outer corrugations of the cup that are formed by compression molding. The composite layer material comprises at least: an outer fabric layer; an inner fabric layer; and an intermediate foaming layer. The intermediate foaming layer has a first surface bonding to the outer fabric layer and a second surface bonding to the inner fabric layer, the first surface having second protruding or concave corrugations, the second protruding or concave corrugations mating with the first protruding or concave corrugations to form the outer corrugations of the cup.

10 Claims, 8 Drawing Sheets

(56) References Cited

U.S. PATENT DOCUMENTS

2004/0224603 A1* 11/2004 Kaye ..... A41C 3/0085
450/1
2009/0061730 A1* 3/2009 Chen ..... A41C 3/144
450/39

* cited by examiner

BRA CUP AND MANUFACTURING METHOD THEREOF

TECHNICAL FIELD

The present invention relates to the field of undergarments, bras, or swimsuit accessories, and in particular, relates to a bra cup and a manufacturing method thereof.

BACKGROUND

At present, corrugations may be designed on cups of some female bras to enhance aesthetic feelings of the bras. A general process is to add corrugations on the outer surface of the cup by means of tattoos, printings, or bonding. In cases of tattoos or bonding, an additional process is desired in the manufacturing process, for example, tattooing on the cup or bonding the manufactured corrugations on the cup. This process is complicated and troublesome, has a low manufacturing efficiency, and severely wastes materials. In case of printing, printed and dyed cloth materials are directly used to manufacture the cups, or printing and dyeing are conducted on the manufactured cups. The corrugations made by this process achieve no three-dimensional effect and accurate positioning-based printing is hard to implement. This process is only applicable to the manufacture of base corrugations. In addition, in case of printing, planar corrugations may be manufactured only, but corrugations having the three-dimensional effect fail to be manufactured.

SUMMARY

An objective of the present invention is to provide a bra cup having sustainable three-dimensional corrugations and a manufacturing method thereof.

The objective of the present invention is achieved by employing the following technical solutions:

The present invention provides a bra cup, formed by compression molding with a composite layer material and having a protruding outer side face and a concave inner side face, the outer side face having outer corrugations of the cup that are formed by compression molding; wherein the composite layer material comprises at least:

an outer fabric layer, having first protruding or concave corrugations;

an inner fabric layer; and an intermediate foaming layer, having a first surface bonding to the outer fabric layer and a second surface bonding to the inner fabric layer, the first surface having second protruding or concave corrugations, the second protruding or concave corrugations mating with the first protruding or concave corrugations to form the outer corrugations of the cup.

According to the present invention, the outer fabric layer and the inner fabric layer are made of elastic fabric that achieves comfort when being in contact with skin of the human body, for example, cotton or the like. The intermediate foaming layer is made of a hot compression molded elastic foaming material, for example, polyurethane or the like. Such materials are all commonly used materials in modern clothing processes. By means of tailoring and hot compression molding, bra cup structures are formed with the composite layer materials formed of such materials. The second protruding or concave corrugations of the intermediate foaming layer mate with the first protruding or concave corrugations of the outer fabric layer, and are filled within the first protruding or concave corrugations, thereby supporting the first protruding or concave corrugations and thus forming sustainable outer corrugations of the cup.

The bra cup manufacturing method comprises the following steps:

S1. providing an intermediate foaming layer having a first surface and a second surface, and bonding the second surface of the intermediate foaming layer to an inner fabric layer;

S2. tailoring the bonded intermediate foaming layer and inner fabric layer to a desired shape;

S3. bonding an outer fabric layer on the first surface of the intermediate foaming layer; and S4. providing a first mold and a second mold mating with each other, the first mold being a female mold, an inner surface of the first mold being provided with first concave or protruding mold corrugations, the second mold being a male mold, and subjecting the bonded outer fabric layer, intermediate foaming layer and inner fabric layer to hot compression molding between the first mold and the second mold, wherein: a bra cup structure having a protruding outer side face and a concave inner side face is formed by compression molding of the bonded outer fabric layer, intermediate foaming layer and inner fabric layer, the outer side face having outer corrugations of the cup that are formed by compression molding corresponding to the first mold corrugations; the outer fabric layer has first protruding or concave corrugations; and the first surface of the intermediate foaming layer has second protruding or concave corrugations, the second protruding or concave corrugations mating with the first protruding or concave corrugations to form the outer corrugations of the cup.

In a preferred technical solution, an edge of the outer fabric layer protrudes against the intermediate foaming layer and the inner fabric layer, wherein a protrusion portion formed thereby is turned over inwardly and thus bonded to the inner fabric layer to form a binder covering an edge of the bra cup. The binder improves the structural integrity of the bra cup, prevents the composite layer material from separation during washing, and reduces discomfort due to rubbing against skin of human body by coarse edges of the composite layer material.

The binder manufacturing method is an improvement based on the above method. Step S3 comprises: according to the tailored shape of the bonded intermediate foaming layer and inner fabric layer, tailoring the outer fabric layer in a proportional scale-up manner such that an edge of the outer fabric layer protrudes against the intermediate foaming layer and the inner fabric layer, and bonding the outer fabric layer to the first surface of the intermediate foaming layer by means of accurate positioning such that the outer fabric layer forms a lap of protruding hems on an outer side of an edge of the bonded intermediate foaming layer and inner fabric layer; and after step S4, the method further comprises the following step: S5. inwardly turning over the hems of the outer fabric layer that are formed on the outer side of the bonded intermediate foaming layer and inner fabric layer to bond the hems to the inner fabric layer, to form a binder covering an edge of the bra cup.

In a preferred technical solution, the inner side face of the bra cup has one or a plurality of inner protrusion portions of the cup, the inner fabric layer has third protruding corrugations, and the second surface of the intermediate foaming layer has fourth protruding corrugations, the fourth protruding corrugations mating with the third protruding corrugations to form the inner protrusion portions of the cup. The inner protrusion portion of the cup is configured to support female breast, and to further improve comfort and shape capability of the cup.

Specifically, in step S4 of the method, an outer surface of the second mold has second concave mold corrugations; after compression molding of the bonded outer fabric layer, intermediate foaming layer and inner fabric layer, the inner side face of the bra cup has inner protrusion portions of the cup formed by compression molding corresponding to the second mold corrugations; the inner fabric layer has third protruding corrugations; the second surface of the intermediate foaming layer has fourth protruding corrugations, the fourth protruding corrugations mating with the third protruding corrugations to form the inner protrusion portions of the cup.

According to the present invention, not only sustainable three-dimensional corrugations are manufactured on the outer surface of the bra cup at one time by means of simple manufacturing processes, but also comfort of wearing the bra is improved.

DETAILED DESCRIPTION

The present invention is further described with reference to specific embodiments and attached drawings.

Embodiment 1

Figure 1:
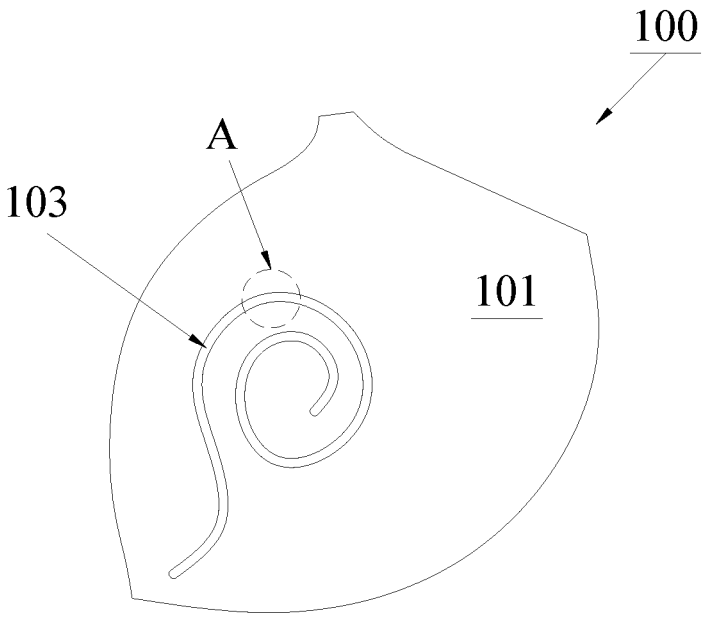
FIG. 1 is a schematic structural view of Embodiment 1 of the present invention.
Figure 2:
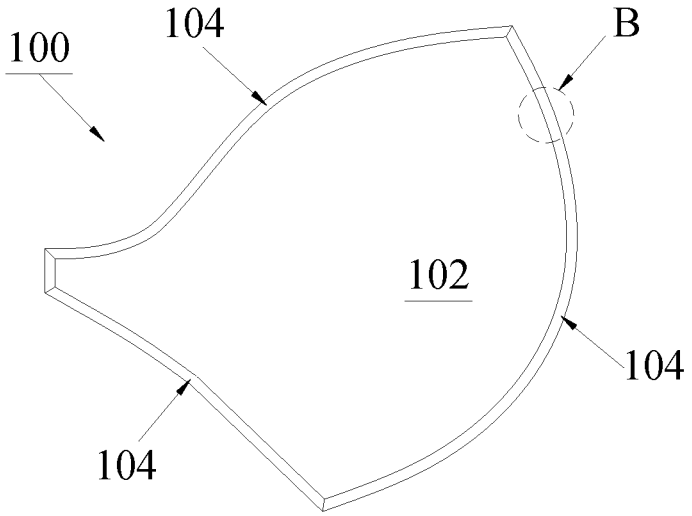
FIG. 2 is a schematic structural view of an inner side in FIG. 1.
Figure 3:
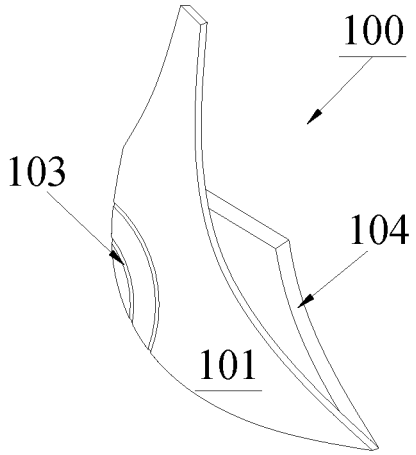
FIG. 3 is a side view of FIG. 1.

As illustrated in FIG. 1 to FIG. 3, a bra cup 100 is formed by compression molding with a composite layer material and has a protruding outer side face 101 and a concave inner side face 102, wherein the outer side face has outer corrugations 103 of the cup that are formed by compression molding, and an edge of the bra cup 100 has a lap of inward binders 104.

Figure 4:
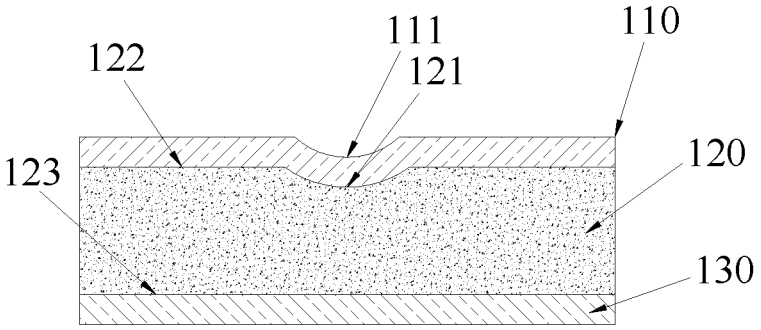
FIG. 4 is an enlarged sectional view of part A in FIG. 1.

FIG. 4 is an enlarged sectional view of part A in FIG. 1. As illustrated in FIG. 4, the composite layer material comprises at least: an outer fabric layer 110, an intermediate foaming layer 120, and an inner fabric layer 130. The intermediate foaming layer 120 has a first surface 122 bonding to the outer fabric layer 110 and a second surface 123 bonding to the inner fabric layer 130. The outer fabric layer 110 has first concave corrugations 111, and the first surface 122 of the intermediate foaming layer 120 has second concave corrugations 121, wherein the second concave corrugations 121 mate with the first concave corrugations 111 to form the outer corrugations 103 of the cup.

Figure 5:
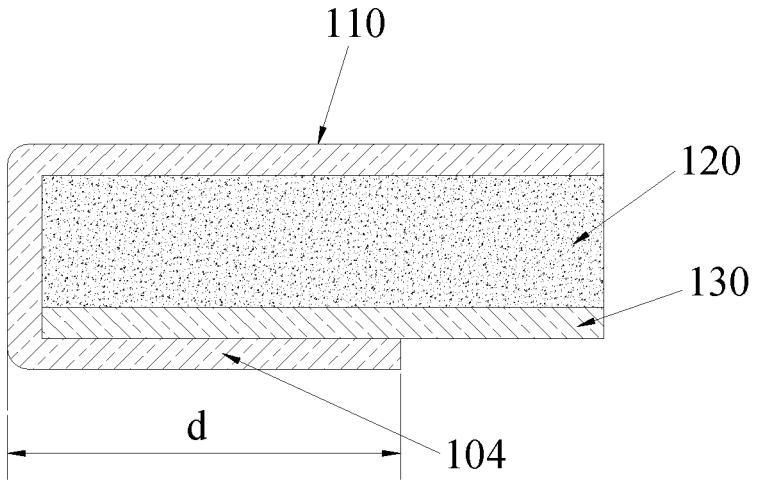
FIG. 5 is an enlarged sectional view of part B in FIG. 2.

FIG. 5 is an enlarged sectional view of part B in FIG. 2. As illustrated in FIG. 5, an edge of the outer fabric layer 110 protrudes against the intermediate foaming layer 120 and the inner fabric layer 130, wherein a protrusion portion formed thereby is turned over inwardly and thus bonded to the inner fabric layer 130 to form a binder 104 covering an edge of the bra cup 100. A width d of the binder 104 is 0.5 cm.

Figure 6A:
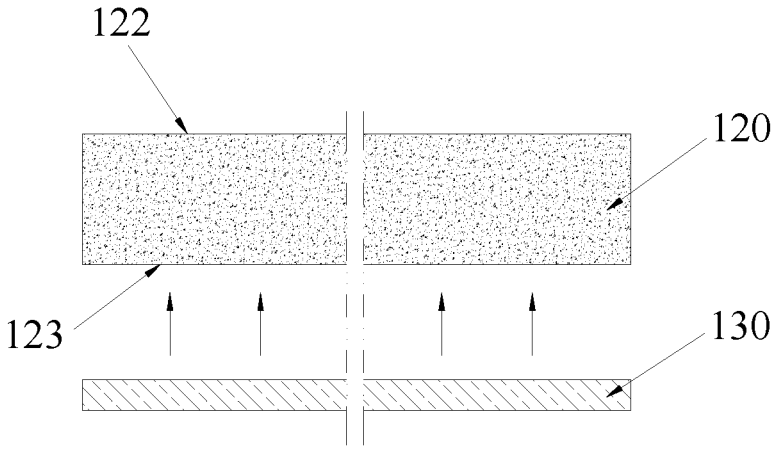
FIGS. 6A to 6E are views illustrating bra cup manufacturing according to Embodiment 1 of the present invention.
Figure 6B:
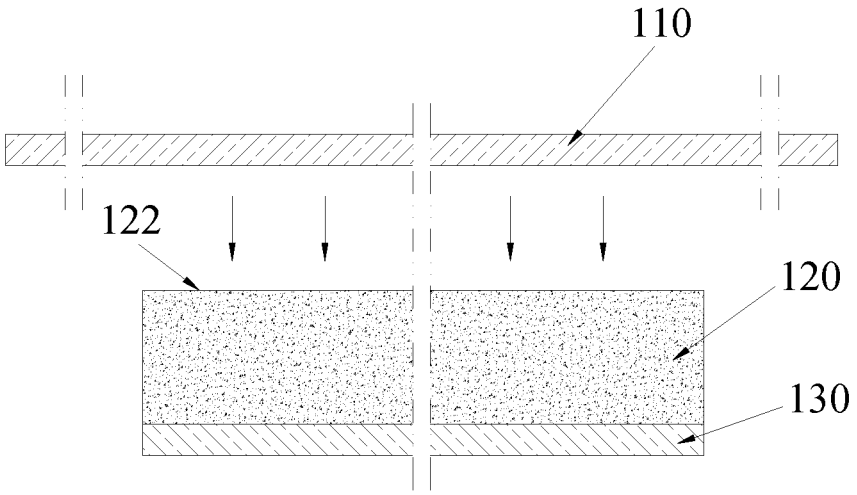
Figure 6C:
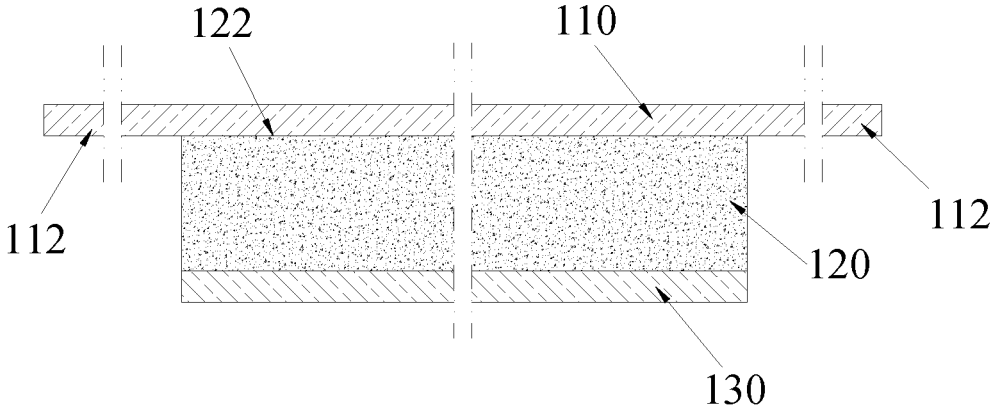
Figure 6D:
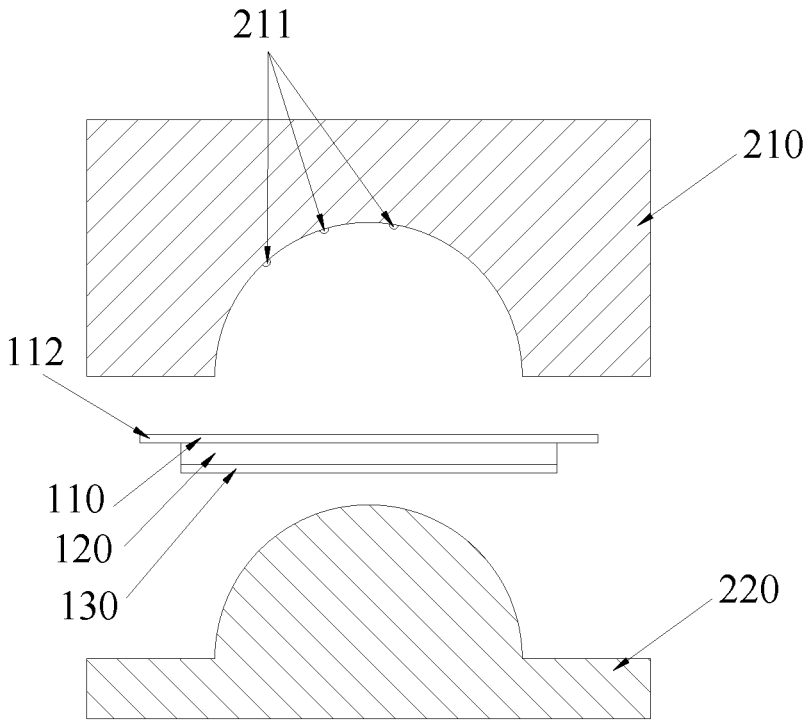
Figure 6E:
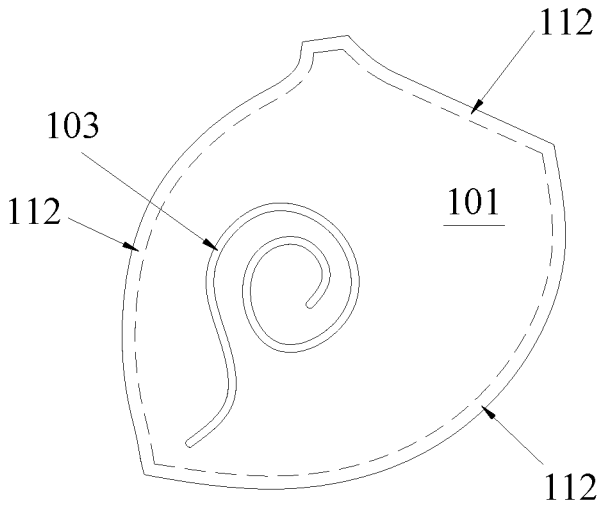

The manufacturing process of the bra cup 100 comprises the following steps:

providing an intermediate foaming layer 120 having a first surface 122 and a second surface 123, and bonding the second surface 123 of the intermediate foaming layer 120 to an inner fabric layer 130, as illustrated in FIG. 6A;

tailoring the bonded intermediate foaming layer 120 and inner fabric layer 130 to a desired shape;

according to the tailored shape of the bonded intermediate foaming layer 120 and inner fabric layer 130, tailoring the outer fabric layer 110 in a proportional scale-up manner such that an edge of the outer fabric layer 110 protrudes against the intermediate foaming layer 120 and the inner fabric layer 130, as illustrated in FIG. 6B;

bonding the outer fabric layer 110 to the first surface 122 of the intermediate foaming layer 120 by means of accurate positioning such that the outer fabric layer 110 forms a lap of protruding hems 112 on an outer side of an edge of the bonded intermediate foaming layer 120 and inner fabric layer 130, as illustrated in FIG. 6C;

providing a first mold 210 and a second mold 220 mating with each other, wherein the first mold 210 is a female mold, an inner surface of the first 210 mold is provided with first concave or protruding mold corrugations 211, and the second mold 220 is a male mold; subjecting the bonded outer fabric layer 110, intermediate foaming layer 120 and inner fabric layer 130 to hot compression molding between the first mold 210 and the second mold 220, as illustrated in FIG. 6D;

wherein: a bra cup structure having a protruding outer side face 101 and a concave inner side face 102 is formed by compression molding of the bonded outer fabric layer 110, intermediate foaming layer 120 and inner fabric layer 130, the outer side face 101 having outer corrugations 103 of the cup that are formed by compression molding corresponding to the first mold corrugations 211, as illustrated in FIG. 6E; and finally, inwardly turning over the hems 112 of the outer fabric layer 110 formed on the outer side of the bonded intermediate foaming layer 120 and inner fabric layer 130 to bond the hems 112 to the inner fabric layer 130, to form a binder 104 covering an edge of the bra cup; after hot compression molding by means of the mold, the outer fabric layer 110 has first concave corrugations 111, the first surface 122 of the intermediate foaming layer 120 has second concave corrugations 121, wherein the second concave corrugations 121 mate with the first concave corrugations 111 to form the outer corrugations 103 of the cup.

Embodiment 2

Figure 7:
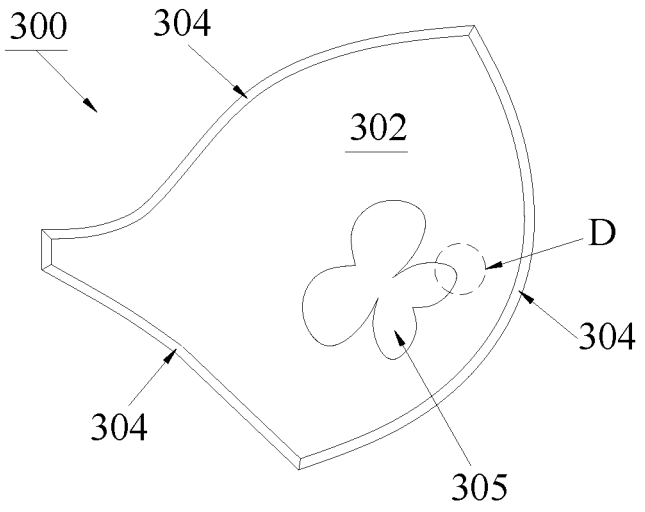
FIG. 7 is a schematic structural view of an inner side according to Embodiment 2 of the present invention.
Figure 8:
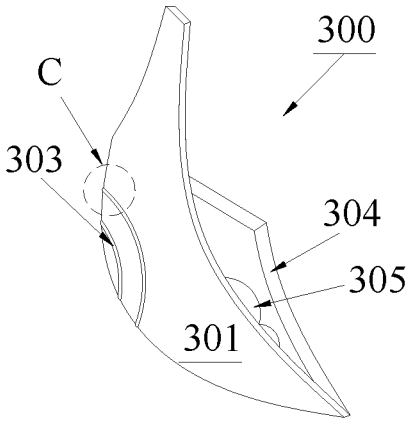
FIG. 8 is a side view of FIG. 7.

As illustrated in FIG. 7 and FIG. 8, preferably, a bra cup 300 is formed by compression molding with a composite layer material and has a protruding outer side face 301 and a concave inner side face 302, wherein the outer side face 301 has outer corrugations 303 of the cup that are formed by compression molding, and an edge of the bra cup 300 has a lap of inward binders 304. A width of the binder 304 is 1.0 cm. The inner side face 302 of the bra cup 300 has an inner protrusion portion 305 of the cup with butterfly corrugations.

Figure 9:
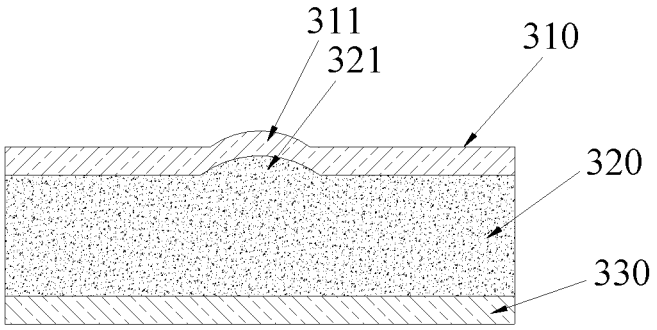
FIG. 9 is an enlarged sectional view of part C in FIG. 8.

FIG. 9 is an enlarged sectional view of part C in FIG. 8. As illustrated in FIG. 9, the composite layer material comprises at least: an outer fabric layer 310, an intermediate foaming layer 320, and an inner fabric layer 330. The outer fabric layer 310 has first protruding corrugations 311, the intermediate foaming layer 320 has second protruding corrugations 321, wherein the second protruding corrugations 321 mate with the first protruding corrugations 311 to form the outer corrugations 303 of the cup.

Figure 10:
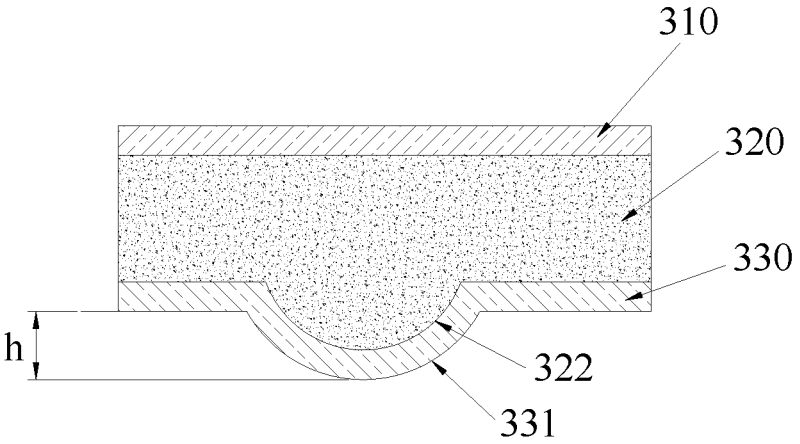
FIG. 10 is an enlarged sectional view of part D in FIG. 7.

FIG. 10 is an enlarged sectional view of part D in FIG. 7. As illustrated in FIG. 10, the inner fabric layer 330 has third protruding corrugations 331, the intermediate foaming layer 320 has fourth protruding corrugations 322, wherein the fourth protruding corrugations 322 mate with the third protruding corrugations 331 to form the inner protrusion portions 305 of the cup. A height h of the inner protrusion portion 305 of the cup is 0.8 cm.

The manufacturing process of the bra cup 300 is similar to that described in Embodiment 1, with a difference in the mold.

Figure 11:
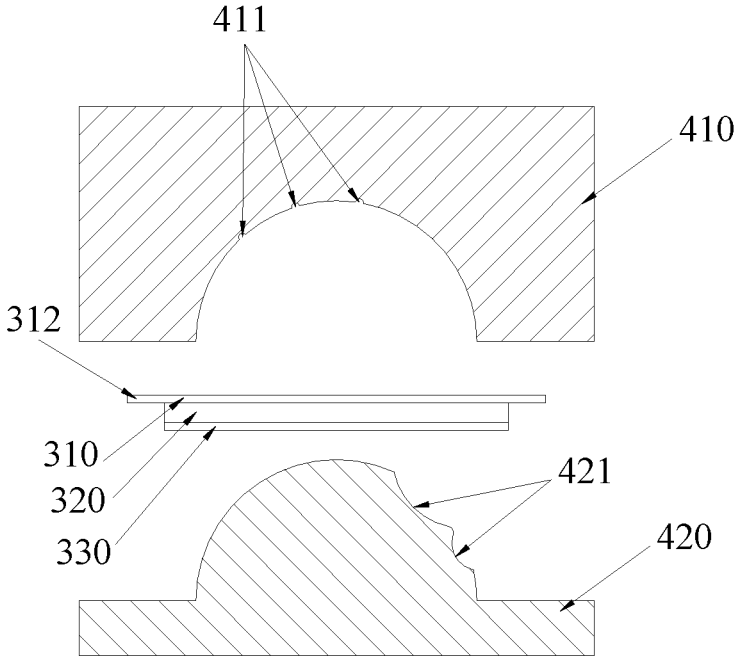
FIG. 11 is a schematic view of hot compression molding according to Embodiment 2 of the present invention.

Likewise, a first mold 410 and a second mold 420 mating with each other are provided. The first mold 410 is a female mold, and an inner surface of the first mold 410 is provided with first concave mold corrugations 411. The second mold 420 is a male mold, and an outer surface of the second mold 420 is provided with second concave mold corrugations 421. The bonded outer fabric layer 310, intermediate foaming layer 320 and inner fabric layer 330 are subjected to hot compression molding between the first mold 410 and the second mold 420, as illustrated in FIG. 11.

A bra cup structure having a protruding outer side face 301 and a concave inner side face 302 is formed by compression molding of the bonded outer fabric layer 310, intermediate foaming layer 320 and inner fabric layer 330, wherein the outer side face 301 has outer corrugations 303 of the cup that are formed by compression molding corresponding to the first mold corrugations 411, and the inner side face has inner protrusion portions 305 of the cup corresponding to the second mold corrugations 421.

What is claimed is:

1. A bra cup, formed by compression molding with a composite layered material and having a protruding outer side face and a concave inner side face, the outer side face having outer corrugations of the cup that are formed by compression molding; wherein the composite layered material comprises at least:

an outer fabric layer, having first protruding and concave corrugations;

an inner fabric layer; and an intermediate foam layer, having a first surface bonding to the outer fabric layer and a second surface bonding to the inner fabric layer, the first surface having second protruding and concave corrugations, the second protruding and concave corrugations mating with the first protruding or concave corrugations to form the outer corrugations of the cup.

2. The bra cup according to claim 1, wherein an edge of the outer fabric layer protrudes against the intermediate foaming layer and the inner fabric layer, a protrusion portion formed by being turned over inwardly and thus bonding to the inner fabric layer to form a binder covering an edge of the bra cup.

3. The bra cup according to claim 2, wherein a width of the binder is within a range of 0.3 to 1.5 cm.

4. The bra cup according to claim 1, wherein the inner side face of the bra cup has one or a plurality of inner protrusion portions of the cup, the inner fabric layer has third protruding corrugations, and the second surface of the intermediate foam layer has fourth protruding corrugations, the fourth protruding corrugations mating with the third protruding corrugations to form the inner protrusion portion of the cup.

5. The bra cup according to claim 4, wherein a height of the inner protrusion portion of the cup is within a range of 0.3 to 1.2 cm.

6. A bra cup manufacturing method, comprising the following steps:

S1. providing an intermediate foam layer having a first surface and a second surface, and bonding the second surface of the intermediate foaming layer to an inner fabric layer;

S2. tailoring the bonded intermediate foaming layer and inner fabric layer to a desired shape;

S3. bonding an outer fabric layer on the first surface of the intermediate foam layer; and S4. providing a first mold and a second mold mating with each other, the first mold being a female mold, an inner surface of the first mold being provided with first concave and protruding mold corrugations, the second mold being a male mold, and subjecting the bonded outer fabric layer, intermediate foam layer and inner fabric layer to hot compression molding between the first mold and the second mold, wherein: a bra cup structure having a protruding outer side face and a concave inner side face is formed by compression molding of the bonded outer fabric layer, intermediate foam layer and inner fabric layer, the outer side face having outer corrugations of the cup that are formed by compression molding corresponding to the first mold corrugations; the outer fabric layer has first protruding and concave corrugations; and the first surface of the intermediate foaming layer has second protruding and concave corrugations, the second protruding and concave corrugations mating with the first protruding and concave corrugations to form the outer corrugations of the cup.

7. The bra cup manufacturing method according to claim 6, wherein step S3 comprises:

according to the tailored shape of the bonded intermediate foam layer and inner fabric layer, tailoring the outer fabric layer such that an edge of the outer fabric layer protrudes against the intermediate foam layer and the inner fabric layer, and bonding the outer fabric layer to the first surface of the intermediate foam layer such that the outer fabric layer forms a lap on an outer side of an edge of the bonded intermediate foaming layer and inner fabric layer;

after step S4, the method further comprises the following step:

S5. inwardly turning over the edge of the outer fabric layer that are formed on the outer side of the bonded intermediate foam layer and inner fabric layer to bond the edge to the inner fabric layer, to form a binder covering an edge of the bra cup.

8. The bra cup manufacturing method according to claim 7, wherein a width of the binder is within a range of 0.3 to 1.5 cm.

9. The bra cup manufacturing method according to claim 6, wherein: in step S4, an outer surface of the second mold has second concave mold corrugations; after compression molding of the bonded outer fabric layer, intermediate foam layer and inner fabric layer, the inner side face of the bra cup has inner protrusion portions of the cup formed by compression molding corresponding to the second mold corrugations; the inner fabric layer has third protruding corrugations; and the second surface of the intermediate foaming layer has fourth protruding corrugations, the fourth protruding corrugations mating with the third protruding corrugations to form the inner protrusion portions of the cup.

10. The bra cup manufacturing method according to claim 9, wherein a height of the inner protrusion portion of the cup is within a range of 0.3 to 1.2 cm.

* * * * *